United States Patent [19]

Fioravanti

[11] 4,270,978

[45] Jun. 2, 1981

[54] POSITIVE PRESSURE FELT DEWATERING AND CLEANING DEVICE AND METHOD

[75] Inventor: Eugene Fioravanti, Averill Park, N.Y.

[73] Assignee: Huyck Corporation, Wake Forest, N.C.

[21] Appl. No.: 62,451

[22] Filed: Jul. 30, 1979

[51] Int. Cl.[3] ..... D21F 1/32; B08B 1/02

[52] U.S. Cl. ..... 162/199; 15/302; 15/306 A; 15/307; 15/316 R; 68/20; 134/15; 134/64 R; 134/122 R; 162/274; 162/275

[58] Field of Search ..... 162/199, 274, 275; 134/64 R, 64 P, 122 R, 122 P, 15, 16, 37; 19/200; 68/20; 15/302, 307, 306 A, 316 R, 345

[56] References Cited

U.S. PATENT DOCUMENTS

| | | | |
|---|---|---|---|
| 1,548,073 | 8/1925 | Vickery | 162/199 |
| 2,352,991 | 7/1944 | Vickery | 15/302 |
| 3,393,123 | 7/1968 | Klingler et al. | 162/274 |

FOREIGN PATENT DOCUMENTS

| | | | |
|---|---|---|---|
| 2312072 | 9/1974 | Fed. Rep. of Germany | 162/274 |
| 1018367 | 1/1966 | United Kingdom | 162/274 |

*Primary Examiner*—Peter Chin

*Attorney, Agent, or Firm*—Sanford S. Wadler

[57] ABSTRACT

Apparatus and method for dewatering papermaker's felt utilizing positive pressure, the felt being deflected in an arc of at least about 90° but less than about 180° by means of a dewatering shoe with a rounded nose having a radius of from about 2" to about 4", the nose of the shoe having an elongated orifice with an effective width of from about 1" to 4" through which air under pressure is directed into the felt. Low pressure flooding means or high pressure shower means may be mounted in the rounded nose of the shoe in advance of the dewatering orifice to direct a cleaning fluid into the felt in advance of dewatering.

7 Claims, 2 Drawing Figures

POSITIVE PRESSURE FELT DEWATERING AND CLEANING DEVICE AND METHOD

BRIEF SUMMARY OF THE INVENTION

This invention relates to a method and means for dewatering and cleaning papermaker's felts subsequent to the removal of the paper web from the felt. Conventional dewatering equipment for felts utilizes vacuum boxes which normally work on the sheet side of the felt, i.e., the side on which the paper web is supported. This approach has several major disadvantages. The vacuum boxes mechanically abrade the sheet side of the felt, thereby decreasing the useful life of the felt. In addition, as the vacuum is increased to enhance water removal, the increased vacuum magnifies the wear rate of the felt surface and also the wear rate of the suction box cover. The increased vacuum also exerts a holding force (drag) on the felt which retards its forward movement and hence requires additional energy to advance the felt in its path of travel.

Efforts have also been made to utilize positive air pressure to dewater felts, but these efforts have not been very successful because they have used rolls to supply the pressurized air to the felt. The roll approach requires the use of relatively large diameter rolls, usually 10" diameter or greater, and rolls of this size do not generate sufficient normal load to maintain an effective seal between the felt and the roll unless very low air pressures are utilized.

In contrast to the foregoing, the present invention utilizes a dewatering shoe having a relatively small radius nose about which the wear or press side of the fabric is caused to travel, the nose incorporating means for directing air under pressure into the felt. With such arrangement, two opposing forces act against each other to maintain a seal between the felt surface and the pressurized shoe. The tension of the felt applies a positive load to the shoe while the pressure in the shoe applies a force in the opposite direction. By balancing these opposing forces the normal load between the felt and the pressurized shoe can be minimized, thereby minimizing wear on both the felt and on the shoe.

Three design parameters interrelate and control the performance of the dewatering shoe. These parameters are air pressure (P) in psi, felt tension (T) in pounds per linear inch of felt width, and shoe radius (R) in inches. Their interrelation is described by the equation:

$$P=T/R$$

The nose radius of the shoe is critical, the lower limit for nose radius being about 2" and the maximum nose radius about 4". However, a nose radius of 2" is preferred for optimum operating conditions. Any air pressure can be utilized in the system which is equal to or less than the pressure (P) indicated in the foregoing equation, with optimum felt dewatering and minimum felt wear occurring when the equation is in equilibrium. Superficially this may seem difficult to achieve; however, equilibrium conditions can be readily achieved due to the fact that the felt will levitate if the pressure (P) exceeds that indicated by the equation, and under these conditions excess air will escape from between the felt and the shoe, thereby effectively controlling the pressure.

In addition to acting as an effective dewatering device, the shoe may incorporate a low pressure flooding shoe or a high pressure shower to provide localized or full felt cleaning. With these additions, the equipment can be used to replace three components of a conventional paper machine yet occupy the space of only one component. The equipment is thus particularly suited to many mill situations where there is inadequate space to install conventional high pressure oscillating showers or large capacity uhle boxes. In particular, the installation of a high pressure shower enhances the performance of conventional high pressure showers in that precise control of the distance between a felt and high pressure shower is extremely difficult to maintain because the high pressure jets tend to deflect the felt, thereby changing the distance between the felt and the high pressure jets. When the high pressure shower is incorporated in the shoe of the present invention, the tension on the felt as it passes around the nose of the shoe generates a sufficiently high normal load so that the kenetic energy of the high pressure jets cannot displace the felt. In addition, the sheet receiving surface of the felt is outermost and will be fully expanded and hence in an ideal condition to be decontaminated by the high pressure jets. The jets themselves, which are enclosed within the shoe, are protected form contamination and mechanical abuse.

DETAILED DESCRIPTION

Figure 1:
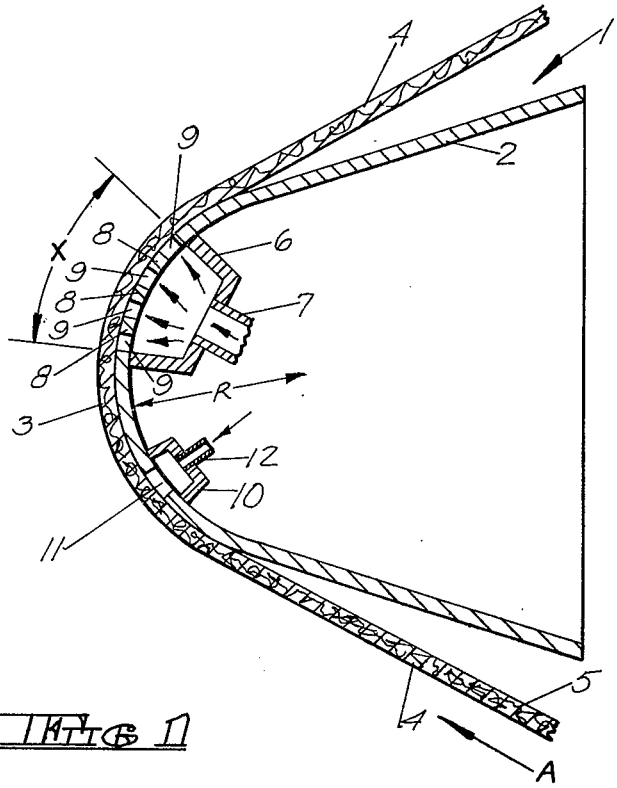
FIG. 1 is a fragmentary vertical sectional view of a dewatering and cleaning shoe in accordance with the invention.

Referring first to FIG. 1, a shoe in accordance with the present invention is indicated at 1. The shoe has a hollow body 2 including a rounded nose 3 having a radius R. The papermaker's felt 4 is adapted to travel about the rounded nose 3 in the direction of the arrow A. The wrap angle of the felt about the nose 3 is not critical, although as will be evident from FIG. 1, the wrap angle is preferably greater than 90° but less than 180°. In this connection, it will be understood that the dewatering shoe will be positioned to contact and deflect the felt from the inner or machine direction side of the felt, which is indicated at 5.

Dewatering of the felt is achieved by means of a pressure box 6 mounted on the inside of the nose 2, the pressure box being connected by means of a conduit 7 to a source of air under positive pressure (not shown). The nose of a shoe has an open area, indicated at X, in communication with the pressure box 6, the felt passing over a series of spaced apart wear bars 8 which define ejection slots 9 through which the pressurized air is forced into and through the felt 4. The pressurized air, as it is forced through the felt, displaces the water carried by the felt, the water being expelled from the outer or sheet side of the felt.

As previously noted, the radius of the nose is critical and preferably should be about 2" for optimum results, although a nose radius of up to 4" may be utilized. The effective width of the open area X is also critical and should be not less than 1" or greater than 4". The term "effective width" means the sum of the widths of the slots 9, i.e., the width X minus the space occupied by the wear bars 8. In an exemplary embodiment of the invention, utilizing a shoe having a 2" nose radius, the tension on the felt is 15 pli (pounds per lineal inch of felt width) and the air pressure is 7.5 psi, which produces the desired equilibrium conditions.

While the arrangement just described provides a highly effective means for dewatering felts, its utility may be enhanced by incorporating a low pressure flooding shoe or a high pressure shower in the nose of the shoe ahead of the pressure box 6. Thus, as illustrated in FIG. 1, a flooding shoe 10 is mounted in advance of the pressure box 6 in the area of nose 3, the flooding shoe communicating with a series of ports 11 extending lengthwise of the shoe in the nose area. It will be understood that the flooding shoe 10 will be connected through conduit 12 to a suitable source of supply.

Figure 2:
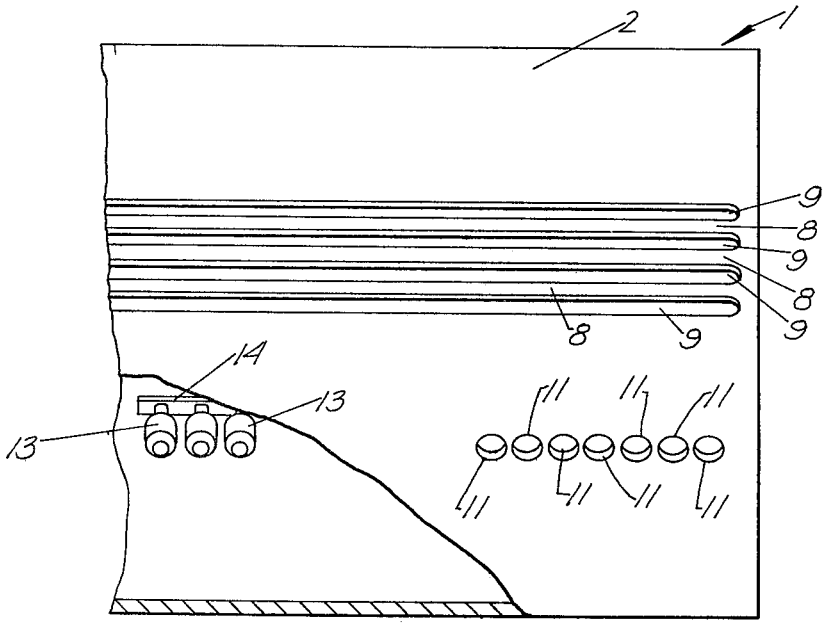
FIG. 2 is a fragmentary side elevational view of the dewatering and cleaning shoe taken from the left side of FIG. 1, with the felt removed.

In place of a flooding shoe, high pressure shower jets can be utilized to provide localized or full felt cleaning. A series of such high pressure jets are diagrammatically indicated at 13 in FIG. 2, it being understood that the jets will be mounted within the confines of the nose of the shoe which will be provided with suitable orifices to permit the spray from the jets to impinge upon the felt. It also will be understood that the jets 13 will be connected by a conduit 14 to a source of fluid under pressure (not shown) which may comprise water, steam or other cleaning fluid.

While a preferred embodiment of the invention has been described and illustrated, it will be understood that modifications may be made in the invention without departing from its spirit and purpose.

What is claimed is:

1. A positive pressure dewatering device for papermaker's felts comprising a hollow shoe having a rounded nose adapted to contact and deflect the felt being dewatered, said nose having a radius of from about 2" to about 4" and an arc which is greater than 90° but less than 180°, an elongated lengthwise orifice in said nose having an effective width of from about 1" to about 4", and means within said shoe in communication with said orifice for discharging air under pressure therethrough.

2. The positive pressure dewatering device claimed in claim 1 wherein wear bars extend lengthwise of said orifice at spaced apart intervals.

3. The positive pressure dewatering device claim in claim 1 including applicator means within the nose of said shoe for injecting cleaning fluid into the felt, said applicator means being positioned ahead of said orifice with respect to the direction of travel of the felt about the nose of said shoe.

4. The positive pressure dewatering device claimed in claim 3 wherein said applicator means comprises a low pressure flooding shoe.

5. The positive pressure dewatering device claimed in claim 3 wherein said applicator means comprises high pressure shower means.

6. A method of dewatering papermaker's felts which comprises the steps of moving the felt in a path of travel, deflecting the moving felt in an arc of at least about 90° but less than about 180° by means of a dewatering shoe with a rounded nose having a radius of from about 2" to about 4", and directing air under pressure into said felt through the rounded nose of said shoe at a pressure determined by the formula $$P=T/R$$

wherein P represents pressure in pounds per square inch, wherein T represents felt tension in pounds per linear inch of felt width, and wherein R represents the radius of the rounded nose of the shoe.

7. The method claimed in claim 6 including the step of directing a cleaning fluid into the felt through the rounded nose of the shoe prior to directing air under pressure into the felt.

* * * * *